US009194013B2

(12) United States Patent
Van Laar et al.

(10) Patent No.: US 9,194,013 B2
(45) Date of Patent: Nov. 24, 2015

(54) HOT BLAST STOVE DOME AND HOT BLAST STOVE

(75) Inventors: Floris Van Laar, Hamilton (CA); Jacobus Van Laar, Driehaus (NL)

(73) Assignee: ALLIED MINERAL PRODUCTS, INC., Columbus, OH (US)

( * ) Notice: Subject to any disclaimer, the term of this patent is extended or adjusted under 35 U.S.C. 154(b) by 664 days.

(21) Appl. No.: 13/027,069

(22) Filed: Feb. 14, 2011

(65) Prior Publication Data

US 2011/0200958 A1 Aug. 18, 2011

Related U.S. Application Data

(60) Provisional application No. 61/303,894, filed on Feb. 12, 2010.

(51) Int. Cl.

| | |
|---|---|
| ***F27D 1/14*** | (2006.01) |
| ***C21B 9/00*** | (2006.01) |
| ***C21B 9/06*** | (2006.01) |
| ***C21B 9/02*** | (2006.01) |
| ***C21B 9/10*** | (2006.01) |
| ***F27D 1/00*** | (2006.01) |
| ***F27D 1/02*** | (2006.01) |
| ***F27D 1/10*** | (2006.01) |
| ***F27D 17/00*** | (2006.01) |

(52) U.S. Cl.

CPC ... *C21B 9/02* (2013.01); *C21B 9/10* (2013.01); *F27D 1/003* (2013.01); *F27D 1/0023* (2013.01); *F27D 1/025* (2013.01); *F27D 1/10* (2013.01); *F27D 17/004* (2013.01)

(58) Field of Classification Search

None

See application file for complete search history.

(56) References Cited

U.S. PATENT DOCUMENTS

| | | | | | |
|---|---|---|---|---|---|
| 1,804,161 | A | * | 5/1931 | Goldsborough et al. | 75/10.34 |
| 1,849,657 | A | * | 3/1932 | Boynton | 432/217 |
| 2,163,149 | A | * | 6/1939 | Linder | 432/214 |
| 2,319,065 | A | * | 5/1943 | Karmanocky | 52/89 |
| 2,408,728 | A | * | 10/1946 | Bowland | 432/214 |
| 2,532,322 | A | * | 12/1950 | McFarlin | 422/202 |
| 2,542,680 | A | * | 2/1951 | Hartwick et al. | 432/32 |
| 2,677,628 | A | * | 5/1954 | Robinson | 134/8 |

(Continued)

FOREIGN PATENT DOCUMENTS

| | | | |
|---|---|---|---|
| DE | 3717497 | A1 | 12/1988 |
| GB | 1295192 | A | 11/1972 |
| GB | 2172982 | A | 10/1986 |

OTHER PUBLICATIONS

Carreau et al, AISTech 2010 Proceedings—vol. I, pp. 469-480 (May 2010).

*Primary Examiner* — Gregory Huson
*Assistant Examiner* — Eric Gorman
(74) *Attorney, Agent, or Firm* — Porter, Wright, Morris & Arthur LLP; Holly Kozlowski

(57) ABSTRACT

A hot blast stove dome comprises a first dome portion adapted for support on a combustion chamber wall of a hot blast stove, and a second dome portion adapted for support on a checker chamber wall of a hot blast stove, wherein a vertical expansion joint is provided between the first dome portion and the second dome portion and is adapted to allow the first dome portion and the second dome portion to independently accommodate vertical expansion of their respective supporting walls. The dome is suitably provided in a hot blast stove which comprises a combustion chamber, a checker chamber, a cylindrical housing comprising a combustion chamber wall and a checker chamber wall.

16 Claims, 3 Drawing Sheets

(56) References Cited

U.S. PATENT DOCUMENTS

| | | | | | |
|---|---|---|---|---|---|
| 3,088,722 | A | * | 5/1963 | Slesaczek | 432/238 |
| 3,153,532 | A | * | 10/1964 | Touzalin | 432/30 |
| 3,223,540 | A | * | 12/1965 | Limes et al. | 501/128 |
| 3,241,823 | A | * | 3/1966 | Pentek | 432/216 |
| 3,297,310 | A | * | 1/1967 | Pentek | 432/214 |
| 3,334,880 | A | * | 8/1967 | Nishida et al. | 432/266 |
| 3,454,267 | A | * | 7/1969 | Slagley et al. | 432/217 |
| 3,528,647 | A | * | 9/1970 | Hyde | 432/251 |
| 3,550,918 | A | * | 12/1970 | Van Laar | 432/217 |
| 3,625,494 | A | * | 12/1971 | Allen | 432/214 |
| 3,713,632 | A | * | 1/1973 | Beenhakker et al. | 432/217 |
| 3,806,313 | A | * | 4/1974 | Van Laar et al. | 432/214 |
| 3,947,245 | A | * | 3/1976 | Zimmermann | 432/217 |
| 4,022,573 | A | * | 5/1977 | Kuntziger | 432/217 |
| 4,145,033 | A | * | 3/1979 | Kuntziger | 266/44 |
| 4,201,543 | A | * | 5/1980 | Hyde | 432/217 |
| 4,221,537 | A | * | 9/1980 | Mamula et al. | 414/800 |
| 4,290,751 | A | * | 9/1981 | Malone et al. | 432/214 |
| 4,311,456 | A | * | 1/1982 | Kletch | 432/30 |
| 4,369,954 | A | * | 1/1983 | Palz | 266/139 |
| 4,375,956 | A | * | 3/1983 | Brandenburg et al. | 432/76 |
| 4,419,075 | A | * | 12/1983 | Hyde | 432/217 |
| 4,444,127 | A | * | 4/1984 | Spronz | 110/235 |
| 4,444,555 | A | * | 4/1984 | Edwardsen et al. | 432/30 |
| 4,478,575 | A | * | 10/1984 | Hyde | 432/217 |
| 4,637,823 | A | * | 1/1987 | Dach | 48/77 |
| 4,986,749 | A | * | 1/1991 | Praat et al. | 432/28 |
| 5,045,176 | A | * | 9/1991 | Walters et al. | 208/113 |
| 5,375,817 | A | * | 12/1994 | Bleijendaal et al. | 266/44 |
| 5,423,519 | A | * | 6/1995 | Connors, Sr. | 266/44 |
| 5,433,599 | A | | 7/1995 | van Laar et al. | |
| 5,928,401 | A | * | 7/1999 | Drummond | 65/475 |
| 6,540,510 | B1 | * | 4/2003 | Abdullah et al. | 432/247 |
| 6,725,787 | B2 | * | 4/2004 | Abdullah et al. | 110/336 |
| 8,317,886 | B2 | * | 11/2012 | Graham et al. | 48/101 |
| 2004/0146828 | A1 | * | 7/2004 | Abdullah et al. | 432/251 |
| 2008/0199820 | A1 | * | 8/2008 | Cellissen et al. | 432/28 |
| 2009/0020111 | A1 | * | 1/2009 | Immordino | 126/9 R |
| 2012/0144644 | A1 | * | 6/2012 | Kurayoshi et al. | 29/426.1 |

* cited by examiner

HOT BLAST STOVE DOME AND HOT BLAST STOVE

RELATED APPLICATIONS

The present application claims priority under 35 U.S.C. §119 to U.S. Application Ser. No. 61/303,894 filed Feb. 12, 2010, incorporated herein by reference.

FIELD OF THE INVENTION

The present invention is directed to a hot blast stove dome and to a hot blast stove having an internal combustion chamber and including the dome of the invention. The hot blast stove dome provides improved resistance to thermal dome damage in a hot blast stove having an internal combustion chamber and results in significant reductions in engineering, materials and construction costs as compared with common conventional apparatus.

BACKGROUND OF THE INVENTION

Hot blast stoves, sometimes referred to as blast furnace stoves, are typically employed in iron manufacturing to preheat combustion air before it enters into a blast furnace. A hot blast stove typically has a cylindrical, silo-shaped wall structure constructed of refractory and insulating brick, and surrounded by a metal shell. Adjoining combustion and checker chambers are defined by a vertically extending internal dividing wall also constructed of refractory materials. The chambers communicate through a passage formed adjacent a dome at the top of the cylindrical structure. The dome protects the steel shell at the top of the blast stove from excessive high temperatures. The dome in a hot blast stove is typically supported either by an extended diameter steel support structure with steel supports or, in the case of an internal dome, by means of the cylindrical wall.

The checker chamber, also referred to as a regenerative chamber, includes tiers of refractory brick having aligned flow passages which extend from the top to the bottom of the chamber. The bricks absorb and store heat from hot exhaust gases which pass through the checker chamber during a heating cycle. The hot gases flow upwardly in the combustion chamber and then travel downwardly through the checker chamber and exit at the bottom of the checker chamber. Once the checker brick has attained a predetermined temperature, the heating cycle is terminated and the blast cycle begins. In the blast cycle, outside air is introduced at the bottom of the checker chamber and travels upwardly and absorbs the stored heat. This preheated air then travels down through the combustion chamber, exits the stove, and enters the blast furnace.

The internal operating temperature in the blast stove varies considerably and is well in excess of 2000° F. in certain portions of the chamber. In the internal dome structure described above, the wall on the combustion chamber side of the blast stove expands faster and thermally cycles more, causing significant expansion and contraction during normal operating cycles, as compared with the wall on the checker chamber side of the blast stove. This difference in expansion over the large height of the blast stoves, typically 200, 300 or more feet tall, contributes to the formation of cracks in the dome and often leads to premature dome failure. Once the hot face of the refractory dome starts to crack, insulation between the dome and the metal shell is compromised. This results in local hot spots on the steel shell. Typically, to cope with these hot spots, the blast stove must be isolated from the blast furnace to conduct repairs. Such repairs can be done by accessing the stove from the outside, requiring scaffolding on the outside of the stove over large heights, typically 200 to 300 feet or more. Commonly, strategic locations are identified on the shell and openings are drilled to weld grout nipples on the shell in the vicinity of a hot spot. The grout nipples are connected to a pump which injects a semi-plastic refractory insulating material into the area. This method is often used many times during the life span of a stove to keep the stove shell from over-heating in the vicinity of a cracked dome. In some cases, the heavy cracking is so excessive and damage on the inside of the dome is so large that locally the dome collapses and repairs on the inside are required. To facilitate these repairs, the blast stove needs to be isolated from the blast furnace and cooled to ambient temperatures to allow access to the inside. All of these described repairs significantly contribute to financial loss due to maintenance costs and the inability to operate the blast stove during the repair maintenance.

In conventional blast stoves, various measures have been taken in attempts to avoid thermal damage to the dome resulting from expansion differences in the outer dome supporting blast stove wall. Typically, the outer wall of the blast stove in the combustion chamber area is provided with both an additional insulation wall and a dense refractory wall inside the dome supporting wall. These additional walls provide additional insulation of the combustion chamber supporting wall to reduce the expansion of the dome supporting wall on the combustion chamber side and equalize its expansion to that of the cooler dome supporting wall on the checker chamber side. Not only does this design require additional engineering, material and construction, its effect in preventing dome cracks and deterioration of the dome structure over the life of the blast stove has been limited as variations in the thermal expansion of the supporting wall in the area of the combustion chamber still occur and often cause significant dome cracking.

Accordingly, there is a need for improved hot blast stove design which overcomes one or more disadvantages of the conventional designs.

SUMMARY OF THE INVENTION

Accordingly, it is an object of the present invention to provide a hot blast stove dome and a hot blast stove which overcome one or more disadvantages of conventional blast stoves.

In one embodiment, the invention is directed to a hot blast stove dome comprising a first dome portion adapted for support on a combustion chamber wall of a hot blast stove, and a second dome portion adapted for support on a checker chamber wall of a hot blast stove. A vertical expansion joint is provided between the first dome portion and the second dome portion and is adapted to allow the first dome portion and the second dome portion to independently accommodate vertical expansion of their respective supporting walls.

In another embodiment, the invention is directed to a hot blast stove which comprises a combustion chamber, a checker chamber, a cylindrical housing comprising a combustion chamber wall and a checker chamber wall, and a dome. The dome comprises a first dome portion adapted for support on the combustion chamber wall, and a second dome portion adapted for support on the checker chamber wall, wherein a vertical expansion joint is provided between the first dome portion and the second dome portion and is adapted to allow the first dome portion and the second dome portion to independently accommodate vertical expansion of their respective supporting walls.

The vertical expansion joint which is provided in the dome allows the dome portion supported by the combustion chamber wall to grow independently of the dome portion supported by the checker chamber wall. Thus, the thermal effect of the wall expansion on the combustion chamber side has no adverse impact on the dome's structural integrity and cracking is reduced or eliminated. Additionally, the hot blast stove dome of the present invention allows the elimination of the insulation and dense walls in the combustion chamber, thereby providing significant engineering, material and construction savings.

These and additional objects and advantages of the present invention will be more fully apparent in view of the following Detailed Description.

BRIEF DESCRIPTION OF THE DRAWINGS

The invention and the following Detailed Description will be more fully understood in view of the Drawings, in which.

The drawings are further described in the following Detailed Description.

DETAILED DESCRIPTION

The present invention is directed to a hot blast stove dome and to a hot blast stove including a dome according to the invention.

Figure 1:
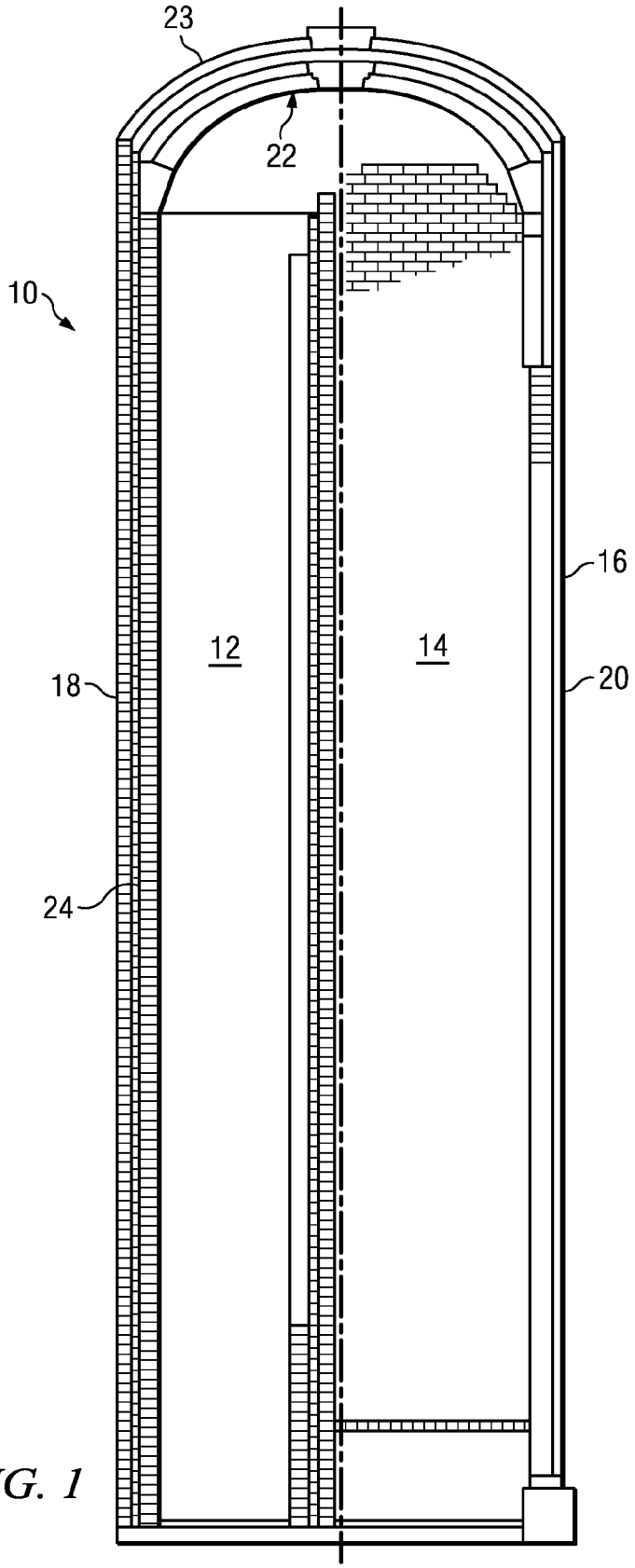
FIG. 1 is a schematic diagram of a conventional hot blast stove.
Figure 2:
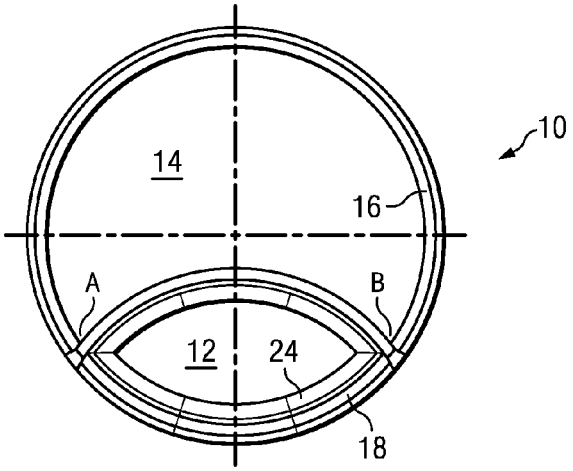
FIG. 2 is a schematic diagram of cross-sectional view of a conventional hot blast stove.

A typical hot blast stove is shown schematically in FIGS. 1 and 2, generally indicated at 10. The hot blast stove 10 comprises a combustion chamber 12, a checker chamber 14, a cylindrical housing 16 comprising a combustion chamber wall 18 and a checker chamber wall 20, and a refractory dome 22. The combustion chamber wall 18 and the checker chamber wall 20 are separated at each of their intersection, shown at points A and B in FIG. 2, by a vertical expansion joint 21, as shown at one intersection in FIG. 3. The housing 16 conventionally comprises a metal shell and a refractory lining, and a metal dome shell 23 encompasses the refractory dome 22. As shown in FIGS. 1 and 2, the portion of the housing comprising the combustion chamber wall 18 includes additional wall layers 24, typically formed of an insulating layer and a dense refractory, to reduce increased vertical expansion of the wall in the vicinity of the combustion chamber 12. As additionally shown, the combustion chamber wall 18 separates the combustion chamber 12 from the checker chamber 14. The dome 22 is supported by means of the cylindrical housing 16 comprising the combustion chamber wall 18 and the checker chamber wall 20.

As noted above, in conventional hot blast stoves, the effect of additional wall layers 24 in preventing dome cracks and deterioration of the dome structure over the life of the blast stove has been limited as variations in the thermal expansion of the supporting wall in the area of the combustion chamber as compared with the supporting wall in the area of the checker chamber still occur. In many instances, dome cracks occur and go undetected as they are not apparent without internal monitoring of the blast stove or temperature monitoring of adjacent shell areas, i.e., at the top of the blast stove, which, in view of the vertical height of these structures, is inconvenient over the life of the blast stove. As the dome cracks go undetected and multiply in number, thermal deterioration of the dome can result, leading to structural failure of the dome.

The dome structure of the present invention reduces the tendency of dome cracking and resulting dome failure. Importantly, with reference to FIG. 3, the hot blast stove dome 22 according to the invention comprises a first dome portion 26 adapted for support on the combustion chamber wall 18 of the hot blast stove, and a second dome portion 28 adapted for support on the checker chamber wall 16 of the hot blast stove. A vertical expansion joint 30 is provided between the first dome portion 26 and the second dome portion 28 and is adapted to allow the first dome portion 26 and the second dome portion 28 to independently accommodate vertical expansion of their respective supporting walls, i.e., the combustion chamber wall 18 and the checker wall 16, respectively. As a result, if the combustion wall 18 thermally expands vertically to a greater degree than the checker wall 16 owing to temperature differences in the combustion chamber and the checker chamber, the vertical expansion joint allows the first dome portion 26 to move independently from the second dome portion 28, resisting cracking of the dome owing to such differences in vertical expansion of the respective supporting walls. Thus, the thermal effect of the wall expansion on the combustion chamber side has no significant adverse impact on the dome's structural integrity. Further, the additional insulating and dense refractory layers 24 employed in conventional constructions may be omitted as the vertical expansion joint is sufficient for preventing dome cracking owing to the differences in thermal expansion. The dome structure of the present invention can therefore provide significant savings in engineering, materials and construction as compared with conventional stoves.

As will be apparent, the life span of both the dome and the stove refractory system will be increased according to the present invention by means of eliminating, or substantially reducing the occurrence, of vertical cracks in the dome. The associated costs encountered in conventional systems for additional maintenance and down time costs are also eliminated by the dome structure of the present invention, which requires very low maintenance. Additionally, as the additional insulating and dense refractory walls 24 my be omitted, the process space both for the heat storage capacity as well as the available surface in the combustion chamber are increased. This will in itself increase the capability for heat storage of the blast stove as well as allow for a larger combustion chamber area which will reduce the velocity of the burned gas and air in the combustion chamber. The reduced velocity will reduce the potential for vibration in the stove.

Figure 3:
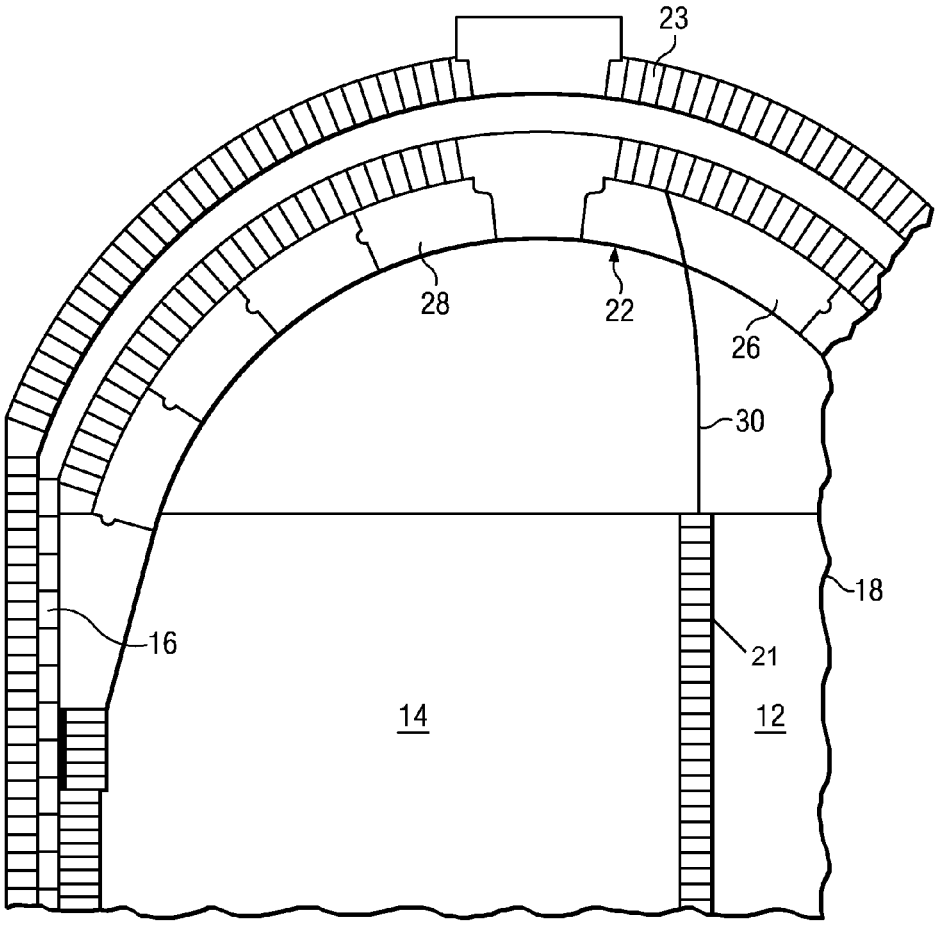
FIG. 3 is a schematic diagram of a partial cross-sectional view of a dome according to the invention.

The vertical expansion joint may extend continuously or non continuously along an arch extending from the first intersection of adjacent edges of the combustion and checker chamber walls to the opposite intersection of adjacent edges of the combustion and checker chamber walls, i.e., from point A, along an arch of the dome, to point B, as shown in FIG. 2. In one specific embodiment, the hot blast stove dome has a substantially hemispherical shape as shown in FIG. 3, and the vertical expansion joint 30 extends continuously from a first edge portion of the substantially hemispherical shape to a second edge portion of the substantially hemispherical shape. A portion of such an expansion joint 30 is shown in FIG. 3.

The dome may be constructed of the indicated elements using any suitable desirable materials. In one embodiment, the dome portions are formed of monolithic castings or refractory brick. As shown in FIG. 3, the castings or brick may be secured with a tongue and groove construction, although other structural embodiments may alternatively used. Suitable casting and refractory materials for use in the dome portions include those known in the art for use in high temperature areas of hot blast stoves. In specific embodiments, the dome portions are formed of aluminosilicate materials, including, but not limited to andalusite, mullite, fused mullite, and combinations thereof. In one embodiment, the dome portions are formed of a refractory castable containing andalusite, mullite, fused mullite, or combinations thereof. The castable may optionally include cement or may be cement-free. In another embodiment, the dome portions are formed of a low cement castable material containing andalusite, mullite, fused mullite, or combinations thereof. In one embodiment, the dome portions are totally or partially formed and cast in place. The cast in place embodiment is advantageous in that special shape brick requirements as well as long lead time for materials and engineering for tight tolerance shapes are reduced. The casting of the dome portions in place also allows reduction in labor installation costs which are typically associated with installing a tight tolerance multi-brick shaped dome. The dimensional tolerances and expansion tolerances are more easily achieved with cast in place dome portion structures.

Finally, the hot blast stoves of the present invention allow stove shutdown for short or longer periods of time to be conducted without negative effects on the dome structure as heat-up and cool down cracking seen in conventional blast stove domes and caused by differential vertical expansion are substantially reduced in the dome structure of the present invention.

Figure 4:
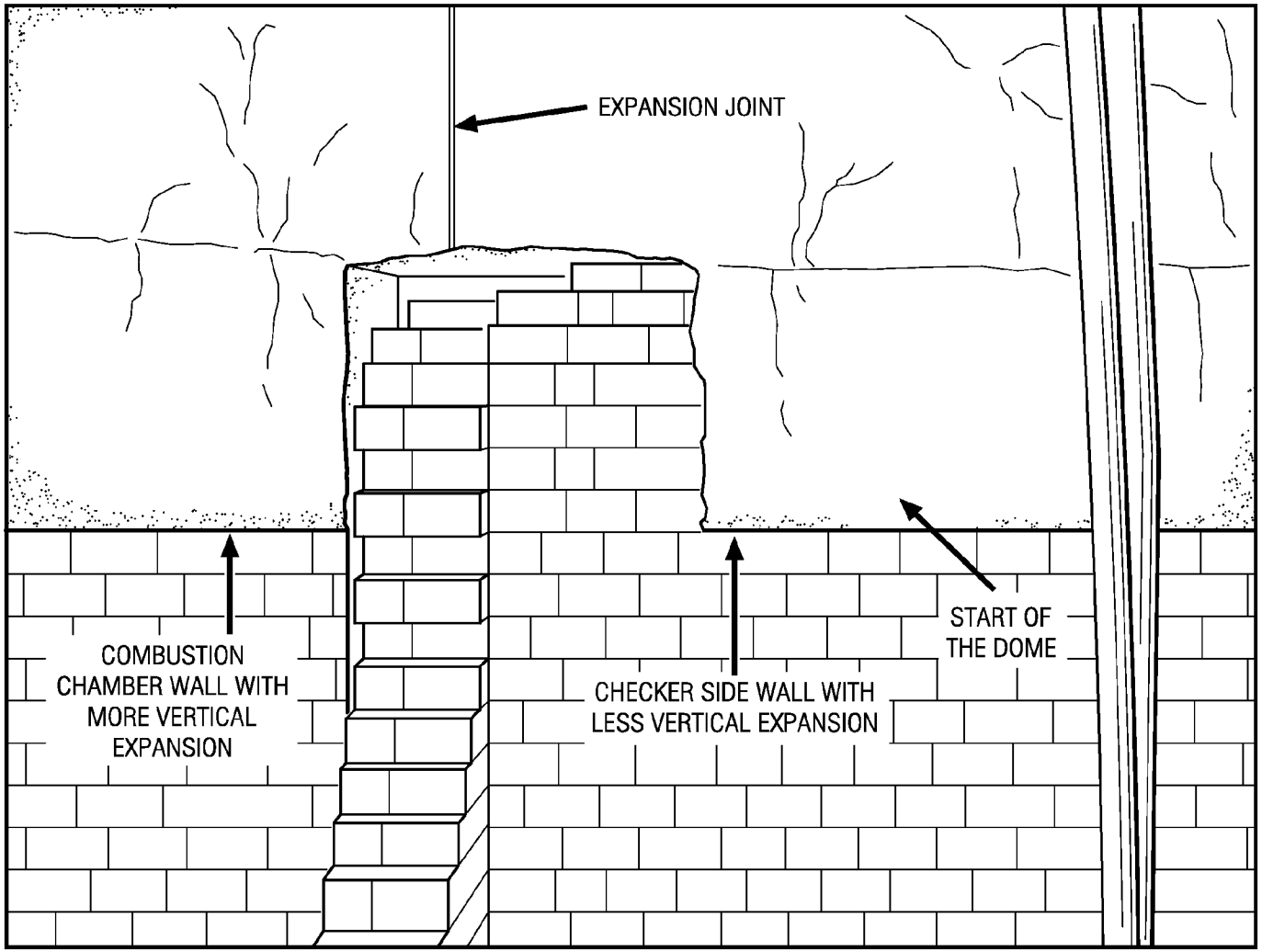
FIG. 4 is a photograph of a dome according to the present invention, installed in a hot blast stove.

A dome structure as described herein was installed in a hot blast stove of a blast furnace. FIG. 4 is a photograph of the dome after installation but prior to operation of the blast stove to determine the effectiveness of the operation of the dome in resisting cracking. Over time, the blast stove has been operated and the shell in the area of the dome has been periodically monitored for hot spots during operation. The monitoring has revealed efficient operation of the dome structure as no shell hot spots have been detected, indicating the insulating layer is intact and significant cracking has been avoided.

The specific examples and embodiments described herein are exemplary only in nature and are not intended to be limiting of the invention defined by the claims. Further embodiments and examples, and advantages thereof, will be apparent to one of ordinary skill in the art in view of this specification and are within the scope of the claimed invention.

What is claimed is:

1. A hot blast stove dome, having a substantially hemispherical shape and comprising a first dome portion adapted for support on top of a vertical combustion chamber wall of a hot blast stove, and a second dome portion adapted for support on top of a vertical checker chamber wall of a hot blast stove, wherein the first dome portion and the second dome portion are arranged adjacent one another and an expansion joint is provided in the hot blast stove dome between the first dome portion and the second dome portion at adjacent edges of the first dome portion and the second dome portion, wherein the expansion joint extends continuously from a first bottom edge portion of the substantially hemispherical shape, along an arch of the dome, to a second bottom edge portion of the substantially hemispherical shape, and wherein the expansion joint is adapted to allow the first dome portion and the second dome portion to independently accommodate vertical expansion of their respective supporting walls.

2. The hot blast stove dome of claim 1, wherein the first dome portion and the second dome portion comprise monolithic castings.

3. The hot blast stove dome of claim 2, wherein the monolithic castings in each dome portion are secured with a tongue and groove construction.

4. The hot blast stove dome of claim 1, wherein the first dome portion and the second dome portion comprise refractory bricks.

5. The hot blast stove dome of claim 4, wherein the bricks in each dome portion are secured with a tongue and groove construction.

6. The hot blast stove dome of claim 1, wherein the dome portions are formed of a material comprising andalusite, mullite, fused mullite, or combinations thereof.

7. A hot blast stove, comprising a combustion chamber, a checker chamber, a cylindrical housing comprising a vertical combustion chamber wall and a vertical checker chamber wall, and a dome having a substantially hemispherical shape, wherein the dome comprises a first dome portion supported on top of the combustion chamber wall, and a second dome portion supported on top of the checker chamber wall, wherein the first dome portion and the second dome portion are arranged adjacent one another and an expansion joint is provided in the hot blast stove dome between the first dome portion and the second dome portion at adjacent edges of the first dome portion and the second dome portion, wherein the expansion joint extends continuously from a first bottom edge portion of the substantially hemispherical shape, along an arch of the dome, to a second bottom edge portion of the substantially hemispherical shape, and wherein the expansion joint is adapted to allow the first dome portion and the second dome portion to independently accommodate vertical expansion of their respective supporting walls.

8. The hot blast stove of claim 7, wherein the combustion chamber wall and the checker chamber wall are formed of the same materials.

9. The hot blast stove of claim 8, wherein the combustion chamber wall and the checker chamber wall comprise a metal shell and a refractory lining.

10. The hot blast stove of claim 7, wherein the combustion chamber wall and the checker chamber wall are separated at each of their intersections by a vertical expansion joint.

11. The hot blast stove of claim 7, wherein the first dome portion and the second dome portion comprise monolithic castings.

12. The hot blast stove of claim 11, wherein the monolithic castings in each dome portion are secured with a tongue and groove construction.

13. The hot blast stove of claim 7, wherein the first dome portion and the second dome portion comprise refractory bricks.

14. The hot blast stove of claim 13, wherein the bricks in each dome portion are secured with a tongue and groove construction.

15. The hot blast stove of claim 7, wherein the dome portions are formed of a material comprising andalusite, mullite, fused mullite, or combinations thereof.

16. The hot blast stove of claim 7, wherein the first bottom edge portion is adjacent a first intersection of the combustion chamber wall and the checker chamber wall, and the second bottom edge portion is adjacent an opposite intersection of the combustion chamber wall and the checker chamber wall.

* * * * *